US007230572B2

(12) United States Patent
Aisenbrey

(10) Patent No.: US 7,230,572 B2
(45) Date of Patent: Jun. 12, 2007

(54) LOW COST ANTENNA DEVICES COMPRISING CONDUCTIVE LOADED RESIN-BASED MATERIALS WITH CONDUCTIVE WRAPPING

(75) Inventor: Thomas Aisenbrey, Littleton, CO (US)

(73) Assignee: Integral Technologies, Inc., Bellingham, WA (US)

( * ) Notice: Subject to any disclaimer, the term of this patent is extended or adjusted under 35 U.S.C. 154(b) by 0 days.

(21) Appl. No.: 10/967,487

(22) Filed: Oct. 18, 2004

(65) Prior Publication Data

US 2005/0078050 A1 Apr. 14, 2005

Related U.S. Application Data

(63) Continuation-in-part of application No. 10/309,429, filed on Dec. 4, 2002, now Pat. No. 6,870,516, which is a continuation-in-part of application No. 10/075,778, filed on Feb. 14, 2002, now Pat. No. 6,741,221.

(60) Provisional application No. 60/519,673, filed on Nov. 13, 2003, provisional application No. 60/512,352, filed on Oct. 17, 2003, provisional application No. 60/317,808, filed on Sep. 7, 2001, provisional application No. 60/269,414, filed on Feb. 16, 2001, provisional application No. 60/268,822, filed on Feb. 15, 2001.

(51) Int. Cl.
*H01Q 1/38* (2006.01)

(52) U.S. Cl. ..... 343/700 MS; 343/788; 343/873

(58) Field of Classification Search ..... 343/700 MS, 343/795, 787, 788, 873

See application file for complete search history.

(56) References Cited

U.S. PATENT DOCUMENTS 3,916,078 A * 10/1975 Priaroggia ..... 174/10
5,990,841 A 11/1999 Sakamoto et al. ..... 343/749

(Continued)

FOREIGN PATENT DOCUMENTS

GB 377449 A 7/2001

(Continued)

OTHER PUBLICATIONS

Co-pending filed Dec. 4, 2002, U.S. Appl. No. 10/309,429, "Low Cost Antennas Using Conductive Plastics or Conductive Composites".

*Primary Examiner*—Hoang V. Nguyen
(74) *Attorney, Agent, or Firm*—Douglas Schnabel

(57) ABSTRACT

Antennas are formed of a conductive loaded resin-based material with conductive wrapping, embedding, and/or center-fusing. The conductive loaded resin-based material comprises micron conductive powder(s), conductive fiber(s), or a combination of conductive powder and conductive fibers in a base resin host. The percentage by weight of the conductive powder(s), conductive fiber(s), or a combination thereof is between about 20% and 50% of the weight of the conductive loaded resin-based material. The micron conductive powders are formed from non-metals, such as carbon, graphite, that may also be metallic plated, or the like, or from metals such as stainless steel, nickel, copper, silver, aluminum that may also be metallic plated, or the like, or from a combination of non-metal, plated, or in combination with, metal powders. The micron conductor fibers preferably are of nickel plated carbon fiber, stainless steel fiber, copper fiber, silver fiber, aluminum fiber, or the like.

79 Claims, 8 Drawing Sheets

U.S. PATENT DOCUMENTS

2001/0050645 A1 12/2001 Boyle ..... 343/702
2002/0089458 A1 7/2002 Allen et al. ..... 343/718
2003/0030591 A1 2/2003 Gipson et al. ..... 343/792
2003/0160732 A1 8/2003 Van Heerden et al. ..... 343/897
2004/0174318 A1* 9/2004 Aisenbrey ..... 343/897

FOREIGN PATENT DOCUMENTS

JP 200021470 A * 1/2000

* cited by examiner

LOW COST ANTENNA DEVICES COMPRISING CONDUCTIVE LOADED RESIN-BASED MATERIALS WITH CONDUCTIVE WRAPPING

This Patent Application claims priority to the U.S. Provisional Patent Application Ser. No. 60/512,352, filed on Oct. 17, 2003, and to U.S. Provisional Patent Application Ser. No. 60/519,673, filed Nov. 13, 2003, which are herein incorporated by reference in its entirety.

This Patent Application is a Continuation-in-Part of INT01-002CTP, filed as U.S. patent application Ser. No. 10/309,429, filed on Dec. 4, 2002, now U.S. Pat. No. 6,870,516 also incorporated by reference in its entirety, which is a Continuation-in-Part application filed as U.S. patent application Ser. No. 10/075,778, filed on Feb. 14, 2002, now U.S. Pat. No. 6,741,221 which claimed priority to U.S. Provisional Patent Applications Ser. No. 60/317,808, filed on Sep. 7, 2001, Ser. No. 60/269,414, filed on Feb. 16, 2001, and Ser. No. 60/268,822, filed on Feb. 15, 2001.

BACKGROUND OF THE INVENTION (1) Field of the Invention

This invention relates to antenna devices and, more particularly, to antenna devices molded of conductive loaded resin-based materials comprising micron conductive powders, micron conductive fibers, or a combination thereof, homogenized within a base resin when molded. This manufacturing process yields a conductive part or material usable within the EMF or electronic spectrum(s).

(2) Description of the Prior Art

Antenna devices are generally classified as any structures capable of receiving and/or transmitting electromagnetic energy. Antennas typically comprise conductive materials capable of converting electromagnetic field energy into electrical currents and visa versa. Of particular importance in the design of useful antenna devices are the concepts of resonance frequency and bandwidth and antenna gain or attenuation. Each antenna structure exhibits characteristic responses to different frequencies of electromagnetic energy. The frequency at which the antenna device exhibits highest gain, or lowest attenuation, is the resonance frequency for the antenna. The range of frequencies around the resonance frequency for which the antenna device exhibits a most useful response, typically defined at −3 dB of resonant gain or the like. These response features depend greatly on the antenna material, shape, size, and signal coupling means. It is an important object of the present invention to provide an improved antenna device that incorporates a unique antenna material, a unique signal coupling and resonance tuning approach, and unique fabrication methods.

Several prior art inventions relate to antenna elements and tuning methods. U.S. Patent Application Publication Us 2003/0030591 A1 to Gipson et al teaches a sleeved dipole antenna with a method to reduce noise utilizing a ferrite sleeve disposed radially around the coaxial feed line. This invention also teaches that the conductive radiators are constructed of aluminum, steel, brass, stainless steel, titanium or copper. U.S. Pat. No. 5,990,841 to Sakamoto et al teaches a wide-band antenna and tuning method utilizing a rod, a movable coil connected to the rod, and a cylindrical conductive holding section. U.S. Patent Application Publications 2001/0050645 A1 to Boyle, 2002/0089458 A1 to Allen et al, and 2003/0160732 A1 to Van Heerden et al teach various antenna devices embedded into fabrics.

SUMMARY OF THE INVENTION

A principal object of the present invention is to provide an effective antenna device.

A further object of the present invention is to provide a method to form an antenna device.

A further object of the present invention is to provide an antenna molded of conductive loaded resin-based materials.

A yet further object of the present invention is to provide an antenna molded of conductive loaded resin-based materials and, further, formed of conductive wires, or threads, wrapped, embedded, or center-fused into the antenna.

A yet further object of the present invention is to provide an antenna molded of conductive loaded resin-based material and conductive wires, or threads, where the wires, or threads, provide a means of tuning the antenna.

A yet further object of the present invention is to provide an antenna molded of conductive loaded resin-based material and conductive wires, or threads, where the wires, or threads, provide a means of coupling a signal onto or off from the antenna.

A yet further object of the present invention is to provide methods to fabricate an antenna from a conductive loaded resin-based material and conductive wires, or threads.

A yet further object of the present invention is to provide a method to fabricate an antenna from a conductive loaded resin-based material where the material is in the form of a fabric.

In accordance with the objects of this invention, an antenna device is achieved. The antenna device comprises an element of conductive loaded, resin-based material comprising conductive materials in a base resin host. A conductive wire is wrapped onto the conductive loaded, resin-based material.

Also in accordance with the objects of this invention, an antenna device is achieved. The antenna device comprises an element of conductive loaded, resin-based material comprising conductive materials in a base resin host. A conductive wire is embedded into the conductive loaded, resin-based material.

Also in accordance with the objects of this invention, a method to form an antenna device is achieved. The method comprises providing a conductive loaded, resin-based material comprising conductive materials in a resin-based host. The conductive loaded, resin-based material is molded into the antenna device. A conductive wire is molded onto the antenna device.

BRIEF DESCRIPTION OF THE DRAWINGS

In the accompanying drawings forming a material part of this description, there is shown.

DESCRIPTION OF THE PREFERRED EMBODIMENTS

Figure 1:
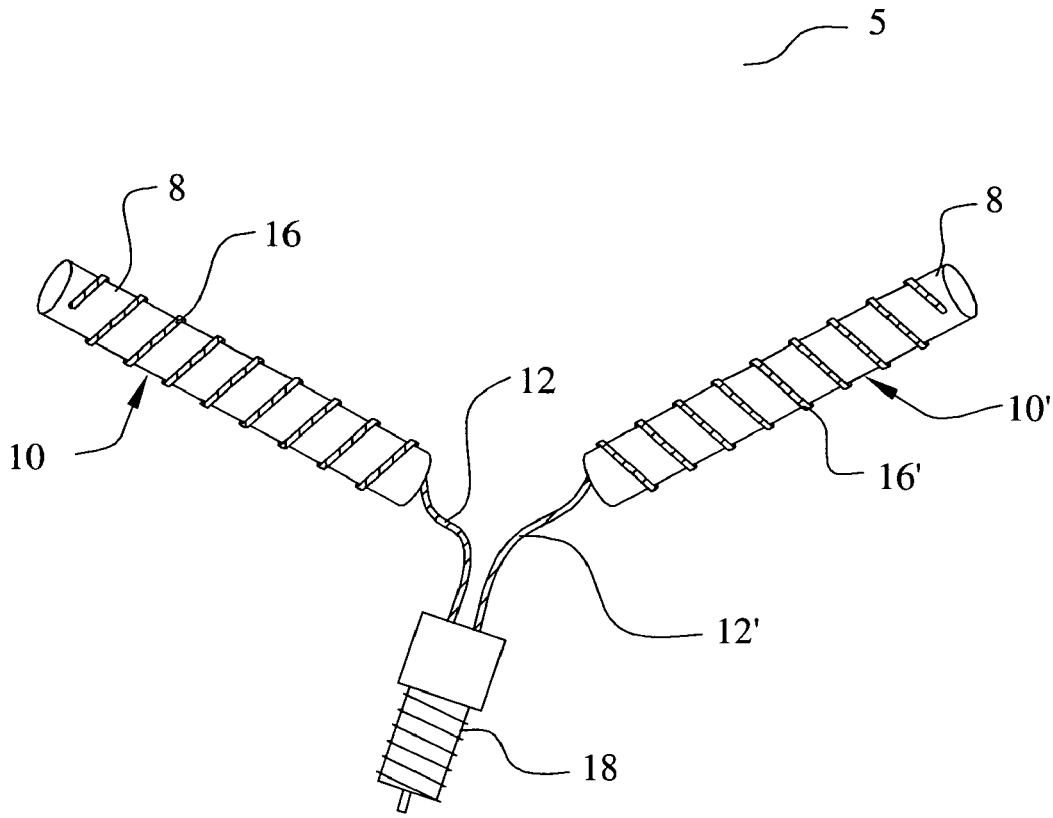
FIG. 1 illustrates a first preferred embodiment of the present invention showing a dipole antenna comprising conductive loaded resin-based material and conductive wires, or threads, according to the present invention. The transmit/receive antenna and counterpoise each comprise conductive loaded resin-based sections with signals coupled using conductive wire that is wrapped around the antenna elements.

This invention relates to antenna devices molded of conductive loaded resin-based materials comprising micron conductive powders, micron conductive fibers, or a combination thereof, homogenized within a base resin when molded.

The conductive loaded resin-based materials of the invention are base resins loaded with conductive materials, which then makes any base resin a conductor rather than an insulator. The resins provide the structural integrity to the molded part. The micron conductive fibers, micron conductive powders, or a combination thereof, are homogenized within the resin during the molding process, providing the electrical continuity.

The conductive loaded resin-based materials can be molded, extruded or the like to provide almost any desired shape or size. The molded conductive loaded resin-based materials can also be cut, stamped, or vacuumed formed from an injection molded or extruded sheet or bar stock, over-molded, laminated, milled or the like to provide the desired shape and size. The thermal or electrical conductivity characteristics of the antenna devices fabricated using conductive loaded resin-based materials depend on the composition of the conductive loaded resin-based materials, of which the loading or doping parameters can be adjusted, to aid in achieving the desired structural, electrical or other physical characteristics of the material. The selected materials used to fabricate the antenna devices are homogenized together using molding techniques and or methods such as injection molding, over-molding, insert molding, thermoset, protrusion, extrusion or the like. Characteristics related to 2D, 3D, 4D, and 5D designs, molding and electrical characteristics, include the physical and electrical advantages that can be achieved during the molding process of the actual parts and the polymer physics associated within the conductive networks within the molded part(s) or formed material(s).

The use of conductive loaded resin-based materials in the fabrication of antenna devices significantly lowers the cost of materials and the design and manufacturing processes used to hold ease of close tolerances, by forming these materials into desired shapes and sizes. The antenna devices can be manufactured into infinite shapes and sizes using conventional forming methods such as injection molding, over-molding, or extrusion or the like. The conductive loaded resin-based materials, when molded, typically but not exclusively produce a desirable usable range of resistivity from between about 5 and 25 ohms per square, but other resistivities can be achieved by varying the doping parameters and/or resin selection(s).

The conductive loaded resin-based materials comprise micron conductive powders, micron conductive fibers, or any combination thereof, which are homogenized together within the base resin, during the molding process, yielding an easy to produce low cost, electrically conductive, close tolerance manufactured part or circuit. The micron conductive powders can be of carbons, graphites, amines or the like, and/or of metal powders such as nickel, copper, silver, aluminum, or plated, or the like. The use of carbons or other forms of powders such as graphite(s) etc. can create additional low level electron exchange and, when used in combination with micron conductive fibers, creates a micron filler element within the micron conductive network of fiber(s) producing further electrical conductivity as well as acting as a lubricant for the molding equipment. The micron conductive fibers can be nickel plated carbon fiber, stainless steel fiber, copper fiber, silver fiber, aluminum fiber, or the like, or combinations thereof. The structural material is a material such as any polymer resin. Structural material can be, here given as examples and not as an exhaustive list, polymer resins produced by GE PLASTICS, Pittsfield, Mass., a range of other plastics produced by GE PLASTICS, Pittsfield, Mass., a range of other plastics produced by other manufacturers, silicones produced by GE SILICONES, Waterford, N.Y., or other flexible resin-based rubber compounds produced by other manufacturers.

The resin-based structural material loaded with micron conductive powders, micron conductive fibers, or in combination thereof can be molded, using conventional molding methods such as injection molding or over-molding, or extrusion to create desired shapes and sizes. The molded conductive loaded resin-based materials can also be stamped, cut or milled as desired to form create the desired shape form factor(s) of the antenna devices. The doping composition and directionality associated with the micron conductors within the loaded base resins can affect the electrical and structural characteristics of the antenna devices and can be precisely controlled by mold designs, gating and or protrusion design(s) and or during the molding process itself. In addition, the resin base can be selected to obtain the desired thermal characteristics such as very high melting point or specific thermal conductivity.

A resin-based sandwich laminate could also be fabricated with random or continuous webbed micron stainless steel fibers or other conductive fibers, forming a cloth like material. The webbed conductive fiber can be laminated or the like to materials such as Teflon, Polyesters, or any resin-based flexible or solid material(s), which when discretely designed in fiber content(s), orientation(s) and shape(s), will produce a very highly conductive flexible cloth-like material. Such a cloth-like material could also be used in forming antenna devices that could be embedded in a person's clothing as well as other resin materials such as rubber(s) or plastic(s). When using conductive fibers as a webbed conductor as part of a laminate or cloth-like material, the fibers may have diameters of between about 3 and 12 microns, typically between about 8 and 12 microns or in the range of about 10 microns, with length(s) that can be seamless or overlapping.

The conductive loaded resin-based material of the present invention can be made resistant to corrosion and/or metal electrolysis by selecting micron conductive fiber and/or micron conductive powder and base resin that are resistant to corrosion and/or metal electrolysis. For example, if a corrosion/electrolysis resistant base resin is combined with stainless steel fiber and carbon fiber/powder, then a corrosion and/or metal electrolysis resistant conductive loaded resin-based material is achieved. Another additional and important feature of the present invention is that the conductive loaded resin-based material of the present invention may be made flame retardant. Selection of a flame-retardant (FR) base resin material allows the resulting product to exhibit flame retardant capability. This is especially important in antenna device applications as described herein.

The homogeneous mixing of micron conductive fiber and/or micron conductive powder and base resin described in the present invention may also be described as doping. That is, the homogeneous mixing converts the typically non-conductive base resin material into a conductive material. This process is analogous to the doping process whereby a semiconductor material, such as silicon, can be converted into a conductive material through the introduction of donor/acceptor ions as is well known in the art of semiconductor devices. Therefore, the present invention uses the term doping to mean converting a typically non-conductive base resin material into a conductive material through the homogeneous mixing of micron conductive fiber and/or micron conductive powder into a base resin.

As an additional and important feature of the present invention, the molded conductor loaded resin-based material exhibits excellent thermal dissipation characteristics. Therefore, antenna devices manufactured from the molded conductor loaded resin-based material can provide added thermal dissipation capabilities to the application. For example, heat can be dissipated from electrical devices physically and/or electrically connected to an antenna device of the present invention.

If a metal layer is formed onto the conductive loaded resin-based material, a typical metal deposition process for forming a metal layer onto the conductive loaded resin-based material is vacuum metallization. Vacuum metallization is the process where a metal layer, such as aluminum, is deposited on the conductive loaded resin-based material inside a vacuum chamber. In a metallic painting process, metal particles, such as silver, copper, or nickel, or the like, are dispersed in an acrylic, vinyl, epoxy, or urethane binder. Most resin-based materials accept and hold paint well, and automatic spraying systems apply coating with consistency. In addition, the excellent conductivity of the conductive loaded resin-based material of the present invention facilitates the use of extremely efficient, electrostatic painting techniques.

The conductive loaded resin-based material can be contacted in any of several ways. In one embodiment, a pin is embedded into the conductive loaded resin-based material by insert molding, ultrasonic welding, pressing, or other means. A connection with a metal wire can easily be made to this pin and results in excellent contact to the conductive loaded resin-based material. In another embodiment, a hole is formed in to the conductive loaded resin-based material either during the molding process or by a subsequent process step such as drilling, punching, or the like. A pin is then placed into the hole and is then ultrasonically welded to form a permanent mechanical and electrical contact. In yet another embodiment, a pin or a wire is soldered to the conductive loaded resin-based material. In this case, a hole is formed in the conductive loaded resin-based material either during the molding operation or by drilling, stamping, punching, or the like. A solderable layer is then formed in the hole. The solderable layer is preferably formed by metal plating. A conductor is placed into the hole and then mechanically and electrically bonded by point, wave, or reflow soldering.

Referring now to FIG. 1, a first preferred embodiment of the present invention is illustrated. Several important features of the present invention are shown and discussed below. Referring now to FIG. 1, an antenna device 5 is shown. The antenna device 5 comprises conductive loaded resin-based material according to the present invention. In particular, a dipole antenna 5 with two sections 10 and 10' is shown. Each section 10 and 10' is formed of the conductive loaded resin-based material of the present invention. The left section 10 is the transmit/receive antenna, or signal antenna, while the right section 10' is the counterpoise.

As an important feature of the present invention, a conductive wire or thread 16 and 16' is wrapped onto, embedded into, or center-fused into each section 10 and 10'. In the particular embodiment shown, a signal wire 16 is wrapped onto the conductive loaded resin-based material 8 of the signal antenna 10. Similarly, a grounding, or counterpoise, wire 16' is wrapped onto the conductive loaded resin-based material 8 of the counterpoise element 10'.

The conductive wire 16 is wrapped through holes in the conductive loaded resin-based material 8. The conductive wire 16 performs several key functions in the unique device 5. First, the conductive wire 16 couples the signal onto (in the case of transmission) or off from (in the case of reception) the conductive loaded resin-based antenna element 10. In the preferred embodiment shown, the conductive wire 16 is not insulated. Therefore, the signal-to-antenna coupling is mostly direct. That is, non-insulated conductive wire, or thread 16, actually contacts the micron conductive network of the antenna material 8. In addition, where the wire 16 is separated from the micron conductive network of the antenna material 8 either by air gaps, by skinning effects at the surface of the conductive loaded resin-based material 8, or by an insulating layer overlying the conductive loaded resin-based material then a capacitive, or indirect coupling to the micron conductive network of the antenna material 8 is created.

The coupling between the wire 16 and the conductive loaded resin-based material 8 creates several unique features to the present invention. First, the conductive wrapping 16 provides an electrical collection point for the micron network of conductive fibers and/or powders within the resin-based material 8. In this respect, and using the analogy of the human vascular system, the micron conductive network of the conductive loaded resin-based material 8 functions like a capillary system while the conductive wire wrapping 16 functions like a vein or artery system connected to the capillary system.

Figure 7:
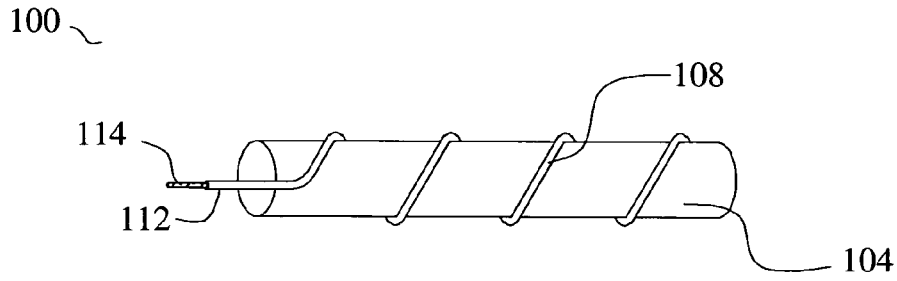
FIG. 7 illustrates a second preferred embodiment of the present invention showing a monopole antenna comprising the conductive loaded resin-based material of the present invention and having a conductive wire wrapped around the antenna.

Since a non-insulated wire 16 is used in this embodiment, the parasitic capacitance of the signal coupling onto the antenna section 8 is small. It is found that resonant response of the antenna element 5 can be tuned for various polarizations by varying the length of the wire wrapping, the shape of the wrapping pattern, and/or the density of wrapping. It is further found that the non-insulated conductive wrapping 16 typically generates a wider resonance bandwidth than an insulated conductive wrapping as is illustrated in FIG. 7 and discussed below. This is because the direct connection between the signal wire 16 and the network of conductive fiber and/or powder creates a larger surface area for conducting current.

Referring now to FIG. 7, a second preferred embodiment of the present invention is illustrated. Another antenna device 100 is shown. In this embodiment, an insulated wire 108 is wrapped around a monopole antenna element 104 comprising the conductive loaded resin-based material. The insulated wire 108 comprises an insulating jacket 112 around the conductive core 114. Therefore, the signal-to-antenna coupling is all capacitive, or indirect. In particular, the wire core 114 and the conductive loaded resin-based material 104 are separated by the insulator 112 such that a parasitic capacitance exists between the wire core 114 and the micron conductive network of the antenna material 104. Signal energy transfer into or out from the conductive loaded resin-based antenna material 104 is distributed gradually across the antenna element 100. An excellent distributed connection is formed between the signal wire 108 and the antenna material 104. In addition, the thickness $T_1$ of insulating jacket 12 of the conductive wrapping 16 may be selected to create a higher capacitive coupling (thinner jacket) or a lower capacitive coupling (thicker jacket). In addition, the type of dielectric material of the insulating jacket 12, even the coloring agents used therein, significantly affects the capacitive coupling.

The wrapping of the insulated conductive wire 108 or thread in pre-determined gauges, patterns, lengths and/or densities around the molded conductive loaded resin-based antenna element 104 plays an important role in tuning the antenna performance. A large electron pathway is established to interact with the molded conductive loaded resin-based network. Electronic conduction via insulated wire 108, or thread, is by capacitive coupling and/or inductive balancing with the micron conductive lattice matrix. The optimized pattern of conductive wire, or thread, wrapping around the conductive loaded resin-based molded element form a mesh of inductors and capacitors integrated into the network of conductive fiber and/or powder in the conductive loaded resin-based material 104. This combined network creates the susceptance, frequency response match location, and resonance bandwidth of the resulting antenna.

In addition, the conductive wrapping 108 provides a very useful method for tuning the antenna 100. The indirect capacitive coupling ($C_{coupling}$) between the signal core 114 and the antenna material 104 provides a complex variable that can used to fine tune the frequency response of the antenna device 100. Generally, the frequency response of the antenna device 100 is established, to first order, by the perimeter dimensions of the antenna section 104. In particular, the antenna element 104 is designed to have perimeter dimensions corresponding to fractional multiples of quarter wavelengths of the desired resonance frequency. As such, the gross, or rough, tuning of the antenna element 100 is set by the size and shape of the conductive loaded resin-based material 104. These dimensions, in turn, are preferably established by molding the conductive loaded resin-based material 104.

Further fine tuning of the antenna 100 resonance properties, such as resonance frequency, the resonance bandwidth, the capacitive balance, the inductive balance, the Q value, and the like, is preferably accomplished by the conductive wrapping 108. In one embodiment, the overall length of the conductive wrapping 108 is adjusted to achieve the desired response. In another embodiment, the number of turns of wrapping 108 or the density of wrapping 108 is adjusted to adjust the resonance response. In another embodiment, the pattern of the wrapping 108 is tailored to fine tune the resonance response. In another embodiment, the gauge of the wrapping wire 108 is used to fine tune the resonance response. In yet another embodiment, the material type of the wire 16, such as copper, aluminum, silver, gold, platinum or the like, is used to fine tune the resonant performance.

A wide variety of antenna structures are easily formed of the conductive loaded resin-based material and conductive stitching technique of the present invention. Monopole, dipole, geometric shapes, 2D, 3D, 4D, 5D, isotropic structures, planar, inverted F, PIFA, and the like, are all within the scope of the present invention.

Figure 8:
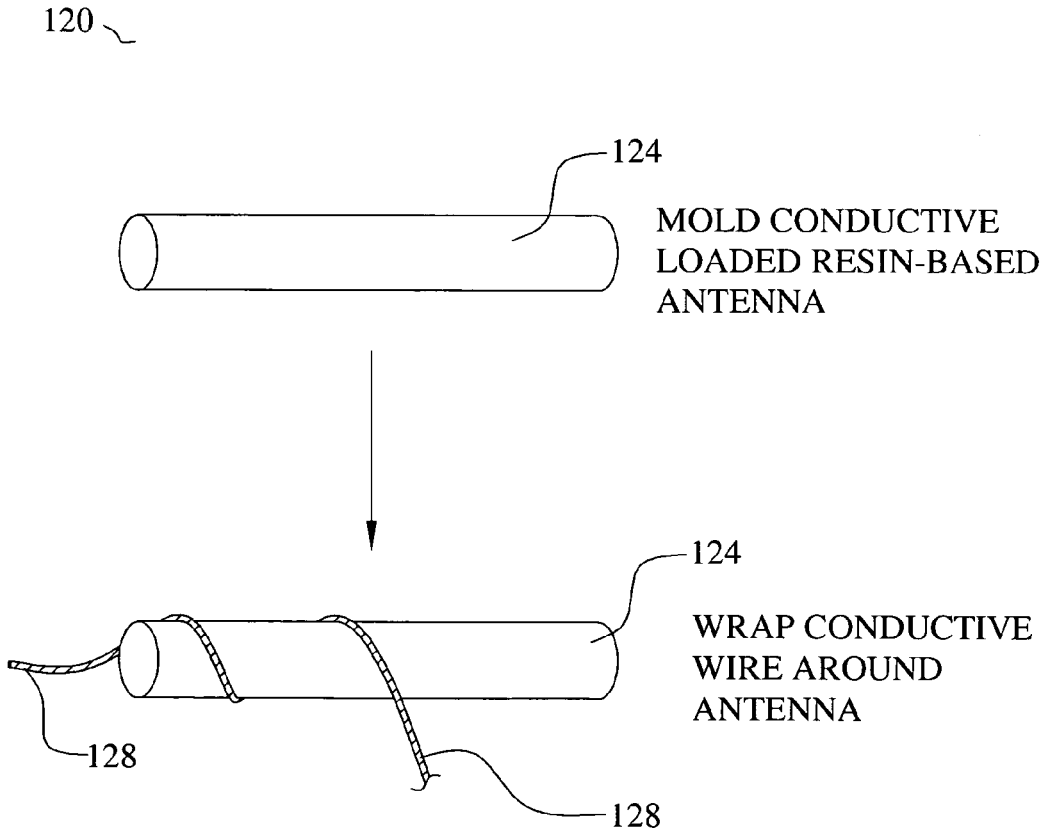
FIG. 8 illustrates a third preferred embodiment of the present invention showing a method to form an antenna device. The antenna device is molded, then wrapped.

Referring now to FIG. 8, a third preferred embodiment of the present invention showing a method 120 to form an antenna device is illustrated. Again, a monopole section 124 of the conductive loaded resin-based material is used. The antenna device is first molded to create the needed shape and perimeter for the desired frequency response. After molding, the antenna section 124 is wrapped with conductive wire 128, or thread. In the illustrated embodiment, the conductive wire 128 comprises non-insulated wire. It an alternative embodiment, the conductive wire 128 comprises an insulated wire.

Figure 9:
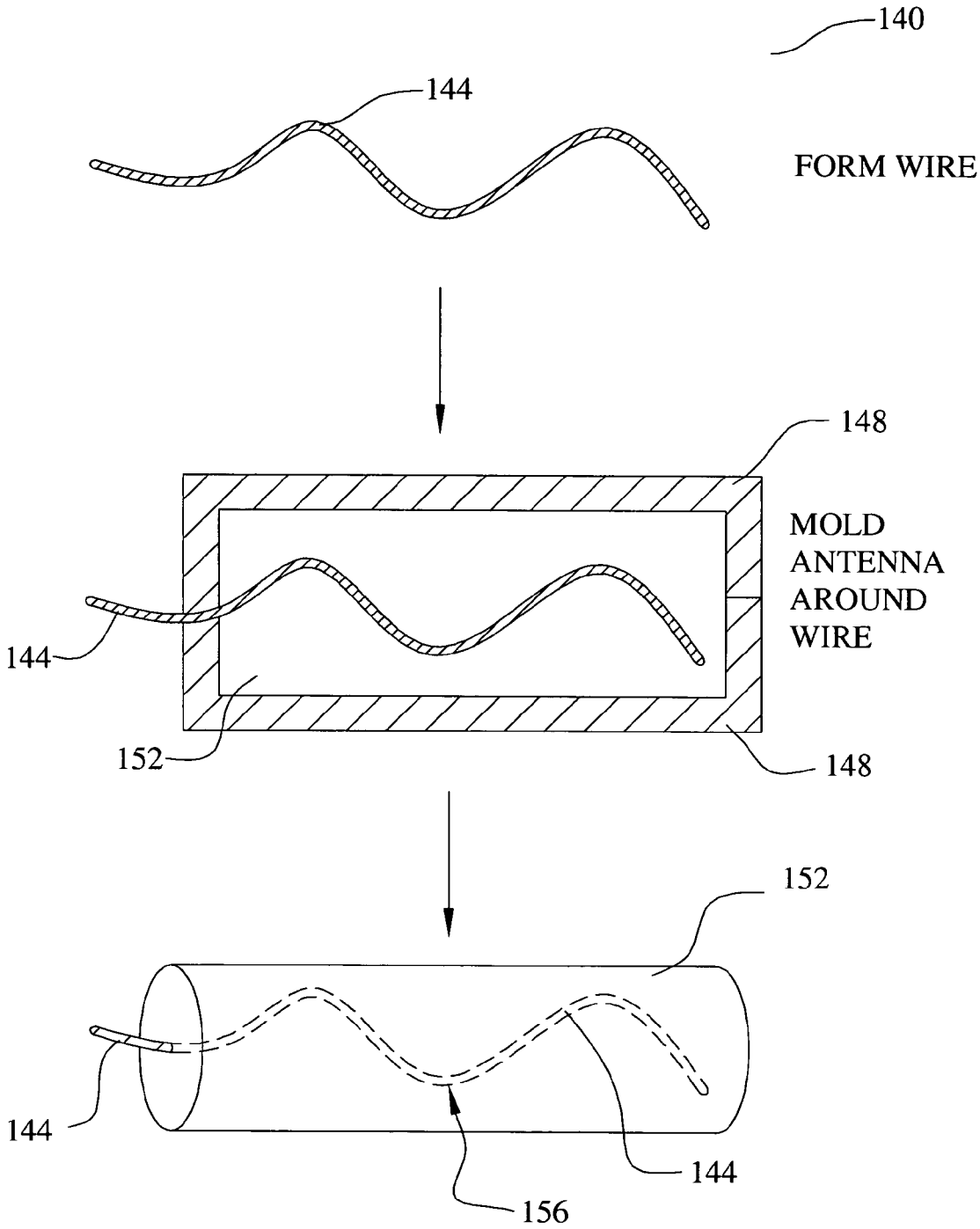
FIG. 9 illustrates a fourth preferred embodiment of the present invention showing a method to form an antenna device. The conductive wire is formed and then molded into the antenna device.

Referring now to FIG. 9, a fourth preferred embodiment of the present invention is illustrated. A method 140 to form a conductive loaded resin-based antenna device 152 with an embedded conductive wire 144 is shown. In one embodiment, the conductive wire 144 comprises a non-insulated wire, or thread, as shown. In another embodiment, the conductive wire 144 comprises an insulated wire having a conductive core and an insulated jacket as in FIG. 7.

Referring again to FIG. 9 and according to another embodiment of the present invention, the conductive wire 144 is formed, or shaped, according to tuning requirements of the antenna. As described above, the wire 144 length, number of turns, density of turns, and the like, is found to be effective for tuning the frequency response and/or polarization response of the completed antenna device. The shaped wire 144 is placed into a molding apparatus 148. According to a preferred embodiment of the present invention, molten conductive loaded resin-based material 152 is injected into the molding apparatus 148 such that the conductive wire 144 is embedded into the conductive loaded resin-based material 152. When the molded antenna device 152 is released from the molding apparatus 148, the conductive wire 146 remains embedded in the conductive loaded resin-based antenna device 152. In another embodiment, the conductive loaded resin-based material is extruded around or onto the conductive wire.

In another embodiment, the conductive wire 144 is not insulated but further comprises a metal plating or coating overlying the outside of the wire or thread. In particular, a metal layer having melting point lower than the melting point of base resin of the conductive loaded resin-based material 152 is coated or plated onto the outer surface of the wire 144. During the molding process, the molten conductive loaded resin-based material 152 cause the metal layer to melt, or flow, such that bonding 156, or direct fusing, occurs between the metal layer and the network of conductive fiber and/or powder in the conductive loaded resin-based material 152. A very low resistance and very effective electrical interface is thereby achieved. Preferably, the metal layer comprises materials such as solder, tin, tin-alloys, balanced zinc content alloys, and the like.

Figure 10:
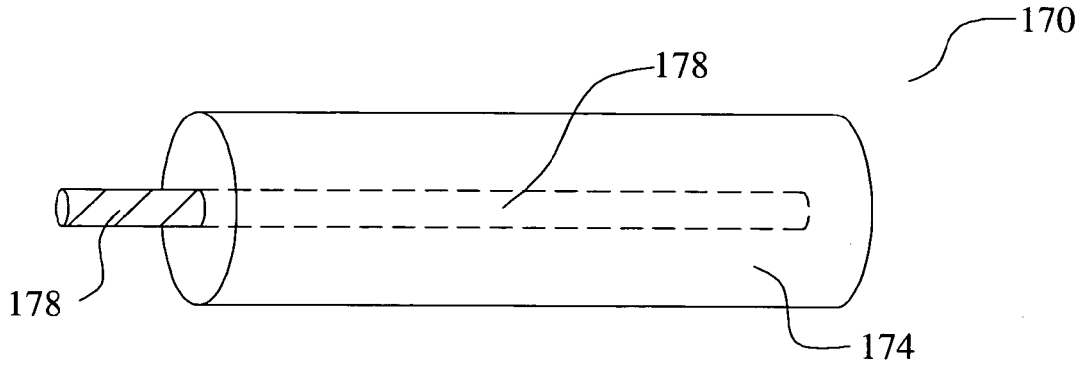
FIG. 10 illustrates a fifth preferred embodiment of the present invention showing a method to form an antenna device. The conductive wire is center-fused into the antenna device.

The embedded conductive wire does not have to be formed into a spiral or multi-directional shape. A straight section of conductive wire may be used. Referring now to FIG. 10, a fifth preferred embodiment 170 of the present invention is illustrated. In this case, a straight, non-insulated conductive wire 178, or thread, is embedded into the conductive loaded resin-based antenna 174. In another embodiment, the conductive wire 178 is insulated and comprises a conductive core and an insulated jacket as in FIG. 7. In another embodiment, the conductive wire is not insulated but is plated or coated with a metal layer as in the fourth preferred embodiment. More preferably, the metal layer has a melting point that is lower than the temperature of the molten conductive loaded resin-based material. During the molding process, the metal layer bonds, or fuses, to the network of conductive fiber and/or powder in the conductive loaded resin-based material. This embodiment is referred to as a center-fused antenna 170.

Figure 11:
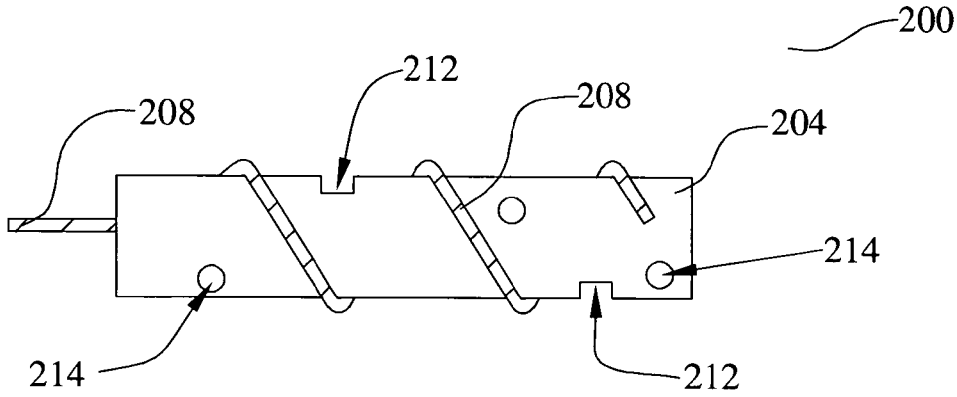
FIG. 11 illustrates a sixth preferred embodiment of the present invention showing a monopole antenna comprising the conductive loaded resin-based material of the present invention having a conductive wire wrapped around the antenna and having slots or holes formed into the conductive loaded resin-based material for fine tuning.

Referring now to FIG. 11, a sixth preferred embodiment of the present invention is illustrated. A monopole antenna 200 is shown. This antenna 200 comprises the conductive loaded resin-based material 204 of the present invention with a conductive wire 208 wrapped around the antenna 204 in similar fashion as in FIG. 1. Referring again to FIG. 11, as a feature of this embodiment, holes 214 and/or slots 212 are formed into or through the conductive loaded resin-based material. It is found that these features 212 and 214 alter the surface area and, thereby, the impedance, capacitance, and inductance of the conductive loaded resin-based material. These features 212 and 214 are used for fine tuning the resonance response of the antenna.

The holes 214 and/or slots 212 are formed in any of several ways. In one embodiment, these features 212 and 214 are molded into the conductive loaded resin-based material 204. In another embodiment, these features 214 and 212 are formed after the molding operation using known material removal techniques such as drilling, stamping, punching, sawing, and the like. The holes 214 and slots 212 are shown on an embodiment of the antenna 200 wherein the conductive wire 208 is wrapped around the antenna core 204. However, these features 214 and 212 are likewise incorporated into an embodiment of the conductive loaded resin-based antenna where the conductive wire is embedded or center-fused into the antenna core.

Figure 12:
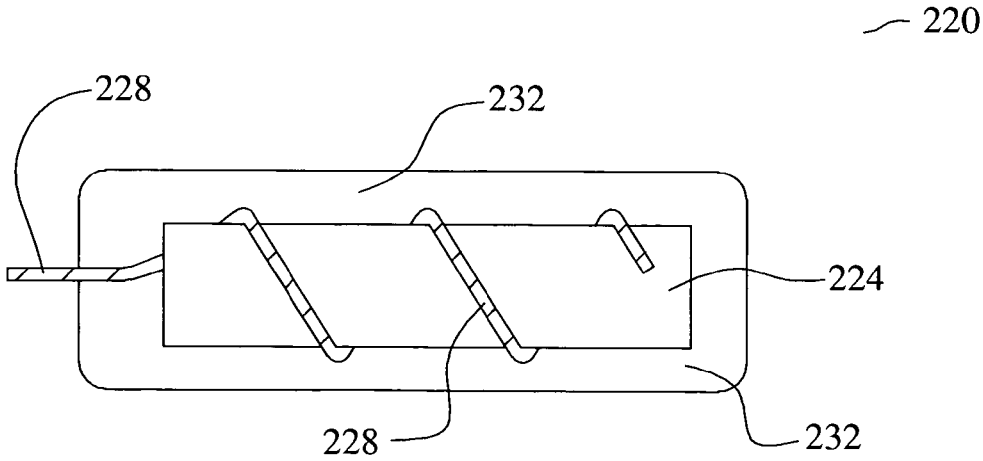
FIG. 12 illustrates a seventh preferred embodiment of the present invention showing an antenna device comprising conductive loaded resin-based material and conductive wire wrapping. A conformal layer is formed over the device for protection, insulation, and/or visual purposes.

Referring now to FIG. 12, a seventh preferred embodiment of the present invention is illustrated. Another monopole antenna 220 is shown. Again, the antenna 220 comprises the conductive loaded resin-based material of the present invention with a conductive wire 228 wrapped around the antenna 224 in similar fashion as in FIG. 1. Referring again to FIG. 12, after the core antenna conductive loaded resin-based material 224 is molded and the conductive wire 228 is wrapped onto the core, a conformal layer 232 is formed over the antenna device 224 and 228. The conformal layer 398 may comprise a heat shrink material, an environmental barrier, an over-molding, a PSA material, or the like. The conformal layer 232 creates a thin wall covering to protect the conductive wire wrapping 228, to provide environmental protection, and/or to provide a visually-attractive covering. The added layer 232 may also influence the performance of the antenna with the addition of dielectric properties that can, in turn, enhance the over-all Q and/or bandwidth of the antenna device 220. In the embodiment shown, the conformal layer 232 is applied after wrapping of a non-insulated conductive wire, or thread, 228. In another embodiment, the conformal layer 232 is applied after wrapping with an insulating wire or thread. In another embodiment, the conformal layer 232 is formed over a conductive loaded resin-based antenna having an embedded or center-fused conductive wire. In yet another embodiment, the conformal layer 232 comprises an over-molding of more conductive loaded resin-based material.

Figure 13:
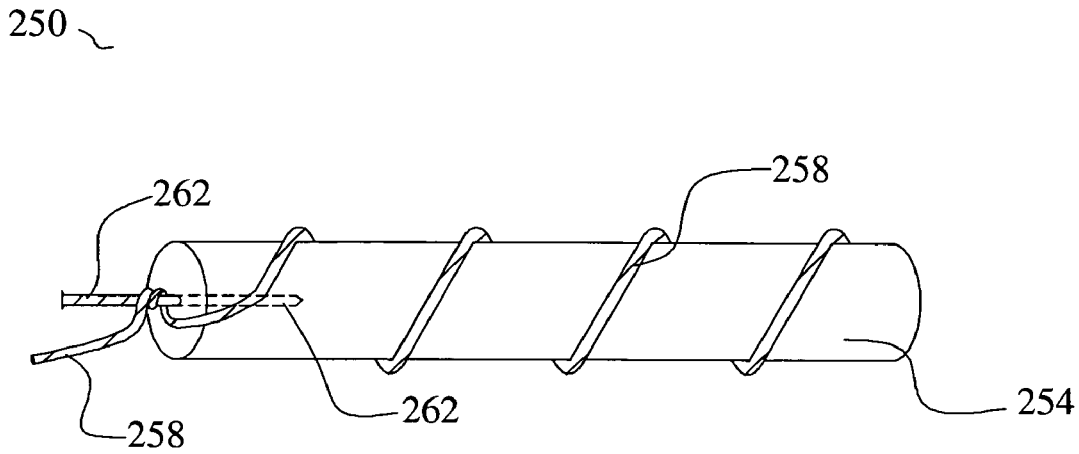
FIG. 13 illustrates an eighth preferred embodiment of the present invention showing an antenna device comprising conductive loaded resin-based material and a conductive wire wrapping. A conductive pin is used to provide an embedded connection to the conductive loaded resin-based material.

Referring now to FIG. 13 an eighth preferred embodiment of the present invention is illustrated. An antenna device 250 comprising conductive loaded resin-based material 254 and a conductive wire wrapping 258 is shown. In this embodiment, a conductive pin 262 is embedded into the conductive loaded resin-based material 254. In one embodiment, a metal pin comprising a material such as brass, is heat-pressed into the conductive loaded resin-based material 254. The metal pin 258 provides a conductive connection to the interior of the conductive loaded resin-based material 254. As a further feature, the conductive wire wrapping 258 is coupled to the conductive pin 262 by, for example, wrapping and/or soldering.

Figure 14:
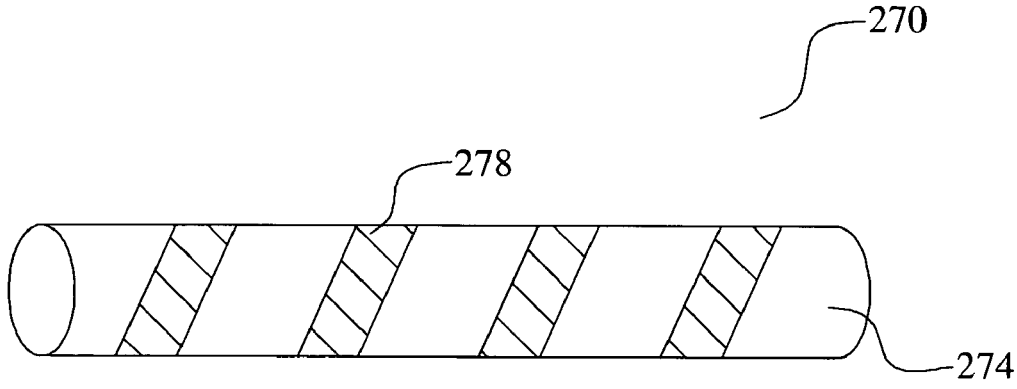
FIG. 14 illustrates a ninth preferred embodiment of the present invention showing an antenna device comprising conductive loaded resin-based material and a helical conductive pattern of plated metal.

Referring now to FIG. 14, a ninth preferred embodiment of the present invention is illustrated. An antenna device 270 is molded of the conductive loaded resin-based material 274 of the present invention by methods described above. A metal layer 278 is then formed overlying the conductive loaded resin-based antenna 274. The metal layer 278 is preferably deposited by a metal deposition or plating process as is described above. In the preferred embodiment, a helical conductive pattern of plated metal 278 is formed.

Figure 2:
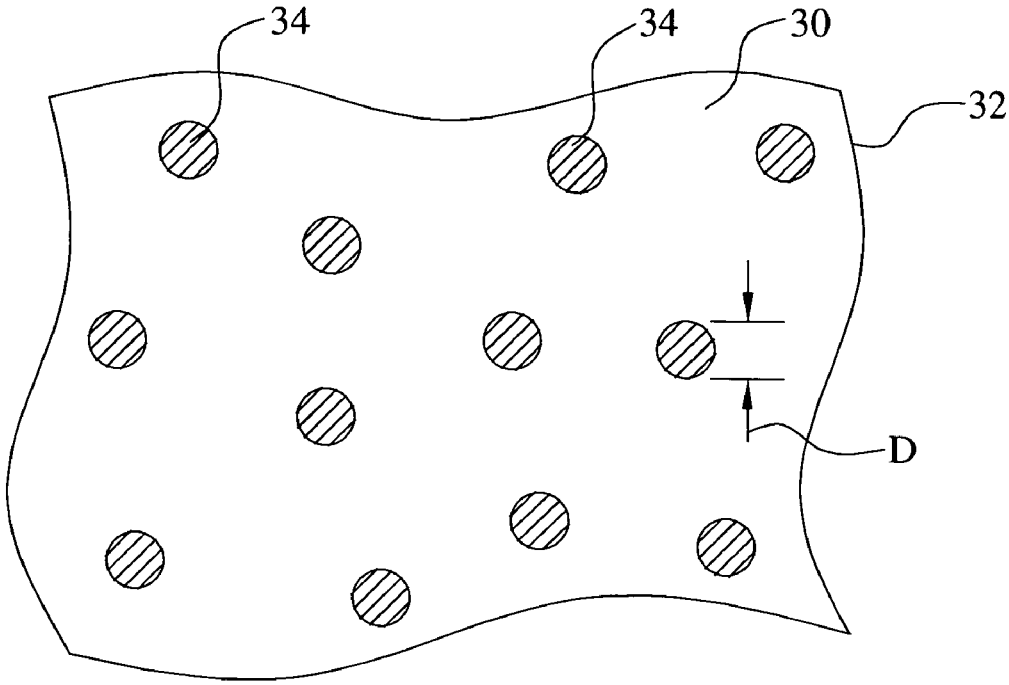
FIG. 2 illustrates a first preferred embodiment of a conductive loaded resin-based material wherein the conductive materials comprise a powder.

The conductive loaded resin-based material of the present invention typically comprises a micron powder(s) of conductor particles and/or in combination of micron fiber(s) homogenized within a base resin host. FIG. 2 shows cross section view of an example of conductor loaded resin-based material 32 having powder of conductor particles 34 in a base resin host 30. In this example the diameter D of the conductor particles 34 in the powder is between about 3 and 12 microns.

Figure 3:
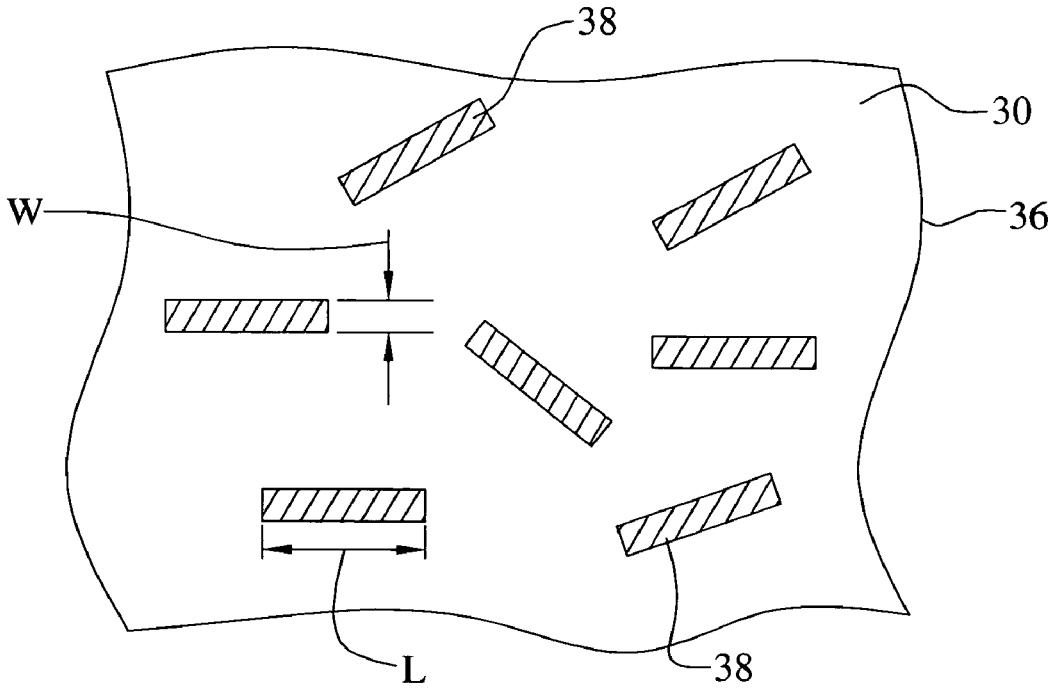
FIG. 3 illustrates a second preferred embodiment of a conductive loaded resin-based material wherein the conductive materials comprise micron conductive fibers.
Figure 4:
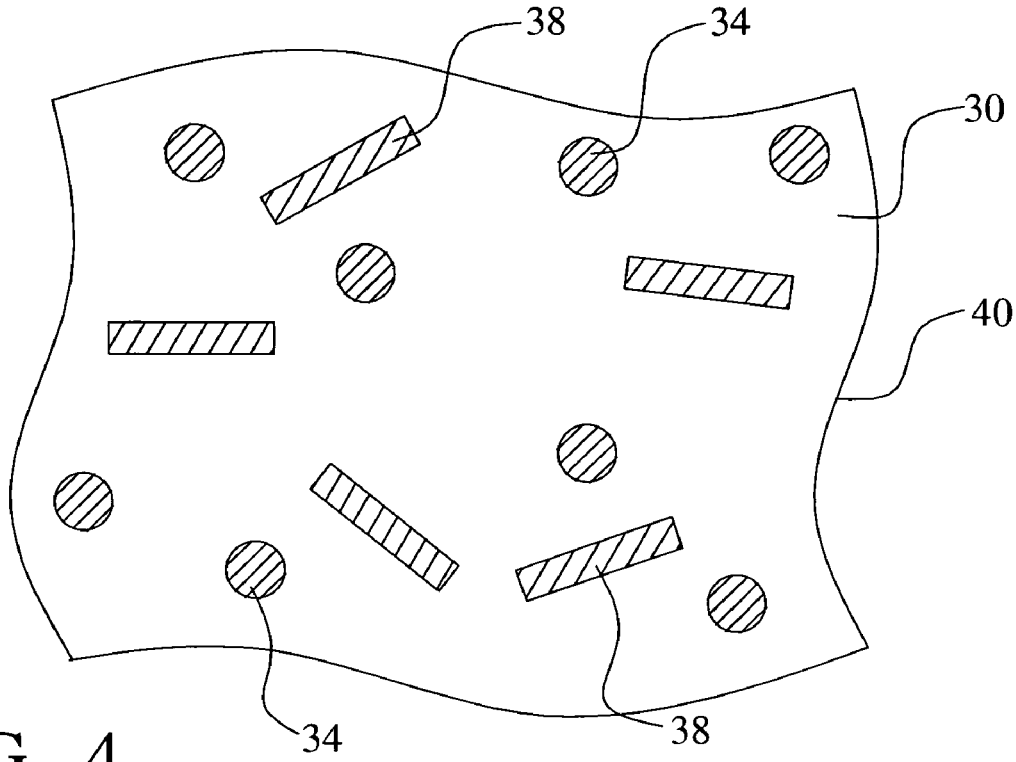
FIG. 4 illustrates a third preferred embodiment of a conductive loaded resin-based material wherein the conductive materials comprise both conductive powder and micron conductive fibers.

FIG. 3 shows a cross section view of an example of conductor loaded resin-based material 36 having conductor fibers 38 in a base resin host 30. The conductor fibers 38 have a diameter of between about 3 and 12 microns, typically in the range of 10 microns or between about 8 and 12 microns, and a length of between about 2 and 14 millimeters. The conductors used for these conductor particles 34 or conductor fibers 38 can be stainless steel, nickel, copper, silver, aluminum, or other suitable metals or conductive fibers, or combinations thereof. These conductor particles and or fibers are homogenized within a base resin. As previously mentioned, the conductive loaded resin-based materials have a sheet resistance between about 5 and 25 ohms per square, though other values can be achieved by varying the doping parameters and/or resin selection. To realize this sheet resistance the weight of the conductor material comprises between about 20% and about 50% of the total weight of the conductive loaded resin-based material. More preferably, the weight of the conductive material comprises between about 20% and about 40% of the total weight of the conductive loaded resin-based material. More preferably yet, the weight of the conductive material comprises between about 25% and about 35% of the total weight of the conductive loaded resin-based material. Still more preferably yet, the weight of the conductive material comprises about 30% of the total weight of the conductive loaded resin-based material. Stainless Steel Fiber of 8-11 micron in diameter and lengths of 4-6 mm and comprising, by weight, about 30% of the total weight of the conductive loaded resin-based material will produce a very highly conductive parameter, efficient within any EMF spectrum. Referring now to FIG. 4, another preferred embodiment of the present invention is illustrated where the conductive materials comprise a combination of both conductive powders 34 and micron conductive fibers 38 homogenized together within the resin base 30 during a molding process.

Figure 5A:
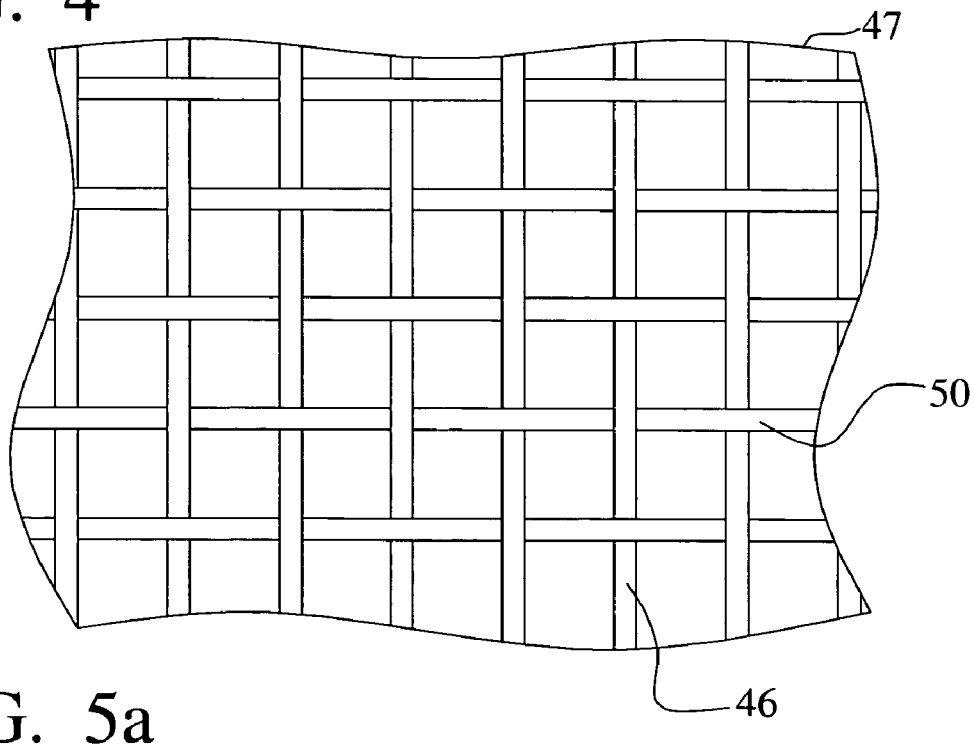
FIGS. 5*a* and 5*b* illustrate a fourth preferred embodiment wherein conductive fabric-like materials are formed from the conductive loaded resin-based material.
Figure 5B:
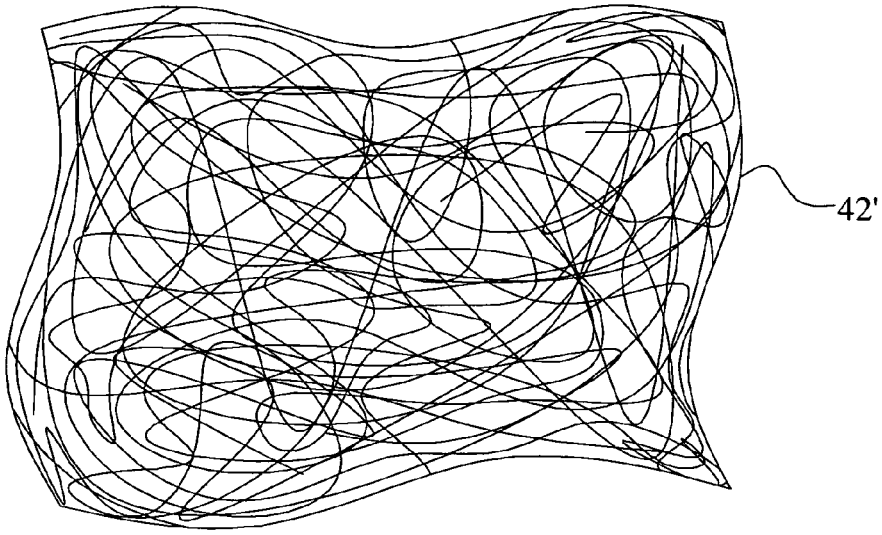

Referring now to FIGS. 5*a* and 5*b*, a preferred composition of the conductive loaded, resin-based material is illustrated. The conductive loaded resin-based material can be formed into fibers or textiles that are then woven or webbed into a conductive fabric. The conductive loaded resin-based material is formed in strands that can be woven as shown. FIG. 5*a* shows a conductive fabric 42 where the fibers are woven together in a two-dimensional weave 46 and 50 of fibers or textiles. FIG. 5*b* shows a conductive fabric 42' where the fibers are formed in a webbed arrangement. In the webbed arrangement, one or more continuous strands of the conductive fiber are nested in a random fashion. The resulting conductive fabrics or textiles 42, see FIG. 5*a*, and 42', see FIG. 5*b*, can be made very thin, thick, rigid, flexible or in solid form(s).

Similarly, a conductive, but cloth-like, material can be formed using woven or webbed micron stainless steel fibers, or other micron conductive fibers. These woven or webbed conductive cloths could also be sandwich laminated to one or more layers of materials such as Polyester(s), Teflon(s), Kevlar(s) or any other desired resin-based material(s). This conductive fabric may then be cut into desired shapes and sizes.

Figure 6A:
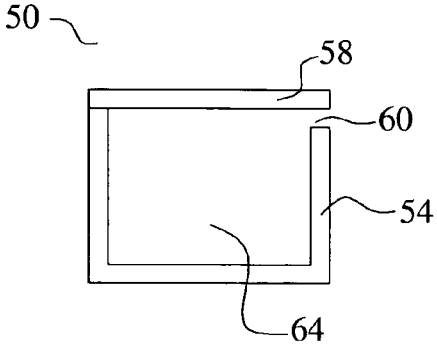
FIGS. 6*a* and 6*b* illustrate, in simplified schematic form, an injection molding apparatus and an extrusion molding apparatus that may be used to mold an antenna of a conductive loaded resin-based material.

Antenna devices formed from conductive loaded resin-based materials can be formed or molded in a number of different ways including injection molding, extrusion or chemically induced molding or forming. FIG. 6*a* shows a simplified schematic diagram of an injection mold showing a lower portion 54 and upper portion 58 of the mold 50. Conductive loaded blended resin-based material is injected into the mold cavity 64 through an injection opening 60 and then the homogenized conductive material cures by thermal reaction. The upper portion 58 and lower portion 54 of the mold are then separated or parted and the antenna devices are removed.

Figure 6B:
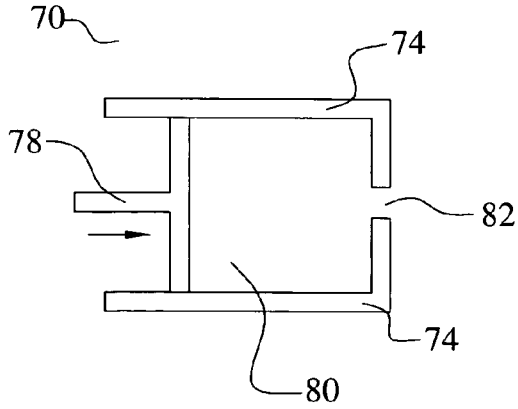

FIG. 6*b* shows a simplified schematic diagram of an extruder 70 for forming antenna devices using extrusion. Conductive loaded resin-based material(s) is placed in the hopper 80 of the extrusion unit 74. A piston, screw, press or other means 78 is then used to force the thermally molten or a chemically induced curing conductive loaded resin-based material through an extrusion opening 82 which shapes the thermally molten curing or chemically induced cured conductive loaded resin-based material to the desired shape. The conductive loaded resin-based material is then fully cured by chemical reaction or thermal reaction to a hardened or pliable state and is ready for use. Thermoplastic or thermosetting resin-based materials and associated processes may be used in molding the conductive loaded resin-based articles of the present invention.

The advantages of the present invention may now be summarized. An effective antenna device is achieved. A method to form an antenna device is also achieved. An antenna molded of conductive loaded resin-based materials is achieved. An antenna is molded of conductive loaded resin-based materials and, further, formed of conductive wires, or threads, wrapped, embedded, or center-fused into the antenna. The antenna molded of conductive loaded resin-based material and conductive wires, or threads provide a means of tuning the antenna. The antenna molded of conductive loaded resin-based material and conductive wires, or threads, provides a means of coupling a signal onto or off from the antenna. Methods to fabricate an antenna from a conductive loaded resin-based material and conductive wires, or threads are achieved. A method to fabricate an antenna from a conductive loaded resin-based material where the material is in the form of a fabric is achieved.

As shown in the preferred embodiments, the novel methods and devices of the present invention provide an effective and manufacturable alternative to the prior art.

While the invention has been particularly shown and described with reference to the preferred embodiments thereof, it will be understood by those skilled in the art that various changes in form and details may be made without departing from the spirit and scope of the invention.

What is claimed is:

1. An antenna device comprising:

an element of conductive loaded, resin-based material comprising conductive materials in a base resin host; and a metal conductor wrapped around said conductive loaded, resin-based material.

2. The device according to claim 1 wherein the percent by weight of said conductive materials is between about 20% and about 50% of the total weight of said conductive loaded resin-based material.

3. The device according to claim 1 wherein the percent by weight of said conductive materials is between about 20% and about 40% of the total weight of said conductive loaded resin-based material.

4. The device according to claim 1 wherein the percent by weight of said conductive materials is between about 25% and about 35% of the total weight of said conductive loaded resin-based material.

5. The device according to claim 1 wherein said conductive materials comprise metal powder.

6. The device according to claim 5 wherein said metal powder is nickel, copper, or silver.

7. The device according to claim 5 wherein said metal powder is a non-conductive material with a metal plating.

8. The device according to claim 7 wherein said metal plating is nickel, copper, silver, or alloys thereof.

9. The device according to claim 5 wherein said metal powder comprises a diameter of between about 3 μm and about 12 μm.

10. The device according to claim 1 wherein said conductive materials comprise non-metal powder.

11. The device according to claim 10 wherein said non-metal powder is carbon, graphite, or an amine-based material.

12. The device according to claim 1 wherein said conductive materials comprise a combination of metal powder and non-metal powder.

13. The device according to claim 1 wherein said conductive materials comprise micron conductive fiber.

14. The device according to claim 13 wherein said micron conductive fiber is nickel plated carbon fiber, or stainless steel fiber, or copper fiber, or silver fiber or combinations thereof.

15. The device according to claim 13 wherein said micron conductive fiber has a diameter of between about 3 μm and about 12 μm and a length of between about 2 mm and about 14 mm.

16. The device according to claim 13 wherein the percent by weight of said micron conductive fiber is between about 20% and about 40% of the total weight of said conductive loaded resin-based material.

17. The device according to claim 13 wherein said micron conductive fiber is stainless steel and wherein the percent by weight of said stainless steel fiber is between about 20% and about 40% of the total weight of said conductive loaded resin-based material.

18. The device according to claim 17 wherein said stainless steel fiber has a diameter of between about 3 μm and about 12 μm and a length of between about 2 mm and about 14 mm.

19. The device according to claim 1 wherein said conductive materials comprise a combination of conductive powder and conductive fiber.

20. The device according to claim 19 wherein said conductive fiber is stainless steel.

21. The device according to claim 1 wherein said base resin and said conductive materials comprise flame-retardant materials.

22. The device according to claim 1 wherein said metal conductor comprises a conductive wire.

23. The device according to claim 22 wherein said conductive wire comprises a center conductor and an insulating jacket.

24. The device according to claim 1 wherein said metal conductor comprises a plated or deposited metal layer.

25. The device according to claim 1 wherein said conductive material is copper, silver, gold, platinum, or aluminum.

26. The device according to claim 1 further comprising a second conductive loaded resin-based element wherein one said conductive loaded resin-based element is a counterpoise.

27. The device according to claim 1 further comprising a conformal layer overlying said conductive loaded resin-based element and said conductive material.

28. The device according to claim 27 wherein said conformal layer is a heat shrink material.

29. The device according to claim 27 wherein said conformal layer is another said conductive loaded resin-based material.

30. The device according to claim 1 further comprising a conductive pin embedded into said conductive loaded resin-based material.

31. The device according to claim 30 wherein said metal conductor is coupled to said conductive pin.

32. An antenna device comprising:

an element of conductive loaded, resin-based material comprising conductive materials in a base resin host; and a conductive wire embedded into said conductive loaded, resin-based material and comprising metal; and a conformal layer overlying said conductive loaded resin-based element and said conductive wire.

33. The device according to claim 32 wherein the percent by weight of said conductive materials is between about 20% and about 40% of the total weight of said conductive loaded resin-based material.

34. The device according to claim 32 wherein the percent by weight of said conductive materials is between about 25% and about 35% of the total weight of said conductive loaded resin-based material.

35. The device according to claim 32 wherein said conductive materials comprise metal powder.

36. The device according to claim 35 wherein said metal powder is a non-conductive material with a metal plating.

37. The device according to claim 35 wherein said metal powder comprises a diameter of between about 3 μm and about 12 μm.

38. The device according to claim 35 wherein said conductive materials comprise non-metal powder.

39. The device according to claim 32 wherein said conductive materials comprise a combination of metal powder and non-metal powder.

40. The device according to claim 32 wherein said conductive materials comprise micron conductive fiber.

41. The device according to claim 40 wherein said micron conductive fiber has a diameter of between about 3 μm and about 12 μm and a length of between about 2 mm and about 14 mm.

42. The device according to claim 40 wherein the percent by weight of said micron conductive fiber is between about 20% and about 40% of the total weight of said conductive loaded resin-based material.

43. The device according to claim 40 wherein said micron conductive fiber is stainless steel and wherein the percent by weight of said stainless steel fiber is between about 20% and about 40% of the total weight of said conductive loaded resin-based material.

44. The device according to claim 43 wherein said stainless steel fiber has a diameter of between about 3 μm and about 12 μm and a length of between about 2 mm and about 14 mm.

45. The device according to claim 32 wherein said conductive materials comprise a combination of conductive powder and conductive fiber.

46. The device according to claim 45 wherein said conductive fiber is stainless steel.

47. The device according to claim 32 wherein said conductive wire comprises a center conductor and an insulating jacket.

48. The device according to claim 47 wherein said center conductor is copper, silver, gold, platinum, or aluminum.

49. The device according to claim 32 further comprising a second conductive loaded resin-based element wherein one said conductive loaded resin-based element is a counterpoise.

50. The device according to claim 32 wherein said conformal layer is a heat shrink material.

51. The device according to claim 32 wherein said conformal layer is another said conductive loaded resin-based material.

52. The device according to claim 32 further comprising a metal layer overlying said conductive wire.

53. The device according to claim 52 wherein said metal layer is bonded to said conductive loaded resin-based material.

54. The device according to claim 32 wherein said conductive wire is in a helical pattern.

55. A method to form an antenna device, said method comprising:

providing a conductive loaded, resin-based material comprising conductive materials in a resin-based host;

molding said conductive loaded, resin-based material into said antenna device; and wrapping a metal conductor onto said antenna device.

56. The method according to claim 55 wherein the percent by weight of said conductive materials is between about 20% and about 40% of the total weight of said conductive loaded resin-based material.

57. The method according to claim 55 wherein said conductive materials comprise micron conductive fiber.

58. The method according to claim 57 wherein said micron conductive fiber is nickel plated carbon fiber, or stainless steel fiber, or copper fiber, or silver fiber or combinations thereof.

59. The method according to claim 57 wherein said micron conductive fiber has a diameter of between about 3 μm and about 12 μm and a length of between about 2 mm and about 14 mm.

60. The method according to claim 57 wherein the percent by weight of said micron conductive fiber is between about 20% and about 40% of the total weight of said conductive loaded resin-based material.

61. The method according to claim 57 wherein said micron conductive fiber is stainless steel and wherein the percent by weight of said stainless steel fiber is between about 20% and about 40% of the total weight of said conductive loaded resin-based material.

62. The method according to claim 61 wherein said stainless steel fiber has a diameter of between about 3 μm and about 12 μm and a length of between about 2 mm and about 14 mm.

63. The method according to claim 55 wherein said conductive materials comprise conductive powder.

64. The method according to claim 55 wherein said conductive materials comprise a combination of conductive powder and conductive fiber.

65. The method according to claim 55 wherein said molding comprises:

injecting said conductive loaded, resin-based material into a mold;

curing said conductive loaded, resin-based material; and removing said antenna device from said mold.

66. The method according to claim 55 wherein said molding comprises:

loading said conductive loaded, resin-based material into a chamber; extruding said conductive loaded, resin-based material out of said chamber through a shaping outlet; and curing said conductive loaded, resin-based material to form said antenna device.

67. The method according to claim 55 further comprising subsequent mechanical processing of said molded conductive loaded, resin-based material.

68. The method according to claim 55 wherein said step of molding said conductive loaded, resin-based material into said antenna device produces perforations in said conductive loaded, resin-based material for said step of wrapping a metal conductor.

69. The method according to claim 55 wherein said metal conductor comprises conductive wire.

70. The method according to claim 69 wherein said conductive wire comprises a center conductor and an insulating jacket.

71. The method according to claim 69 wherein said conductive wire further comprises a metal layer overlying said conductive wire.

72. The method according to claim 55 wherein said step of wrapping a metal conductor comprises routing conductive wiring prior to said step of molding.

73. The method according to claim 55 wherein said metal conductor is copper, silver, gold, platinum, or aluminum.

74. The method according to claim 55 further comprising forming a conformal layer overlying said antenna device.

75. The method according to claim 74 wherein said conformal layer is a heat shrink material.

76. The method according to claim 74 wherein said conformal layer is another said conductive loaded, resin-based material.

77. The method according to claim 55 wherein said metal conductor comprises a plated or deposited metal layer.

78. The method according to claim 55 further comprising embedding a conductive pin into said conductive loaded resin-based material.

79. The method according to claim 78 wherein said metal conductor is connected to said conductive pin.

* * * * *